US009993128B1

(12) United States Patent
Chung

(10) Patent No.: US 9,993,128 B1
(45) Date of Patent: Jun. 12, 2018

(54) VACUUM CLEANER

(71) Applicant: Zeng Hsing Industrial Co., Ltd., Taichung (TW)

(72) Inventor: Chin-Chao Chung, Taichung (TW)

(73) Assignee: Zeng Hsing Industrial Co., Ltd, Taichung (TW)

( * ) Notice: Subject to any disclaimer, the term of this patent is extended or adjusted under 35 U.S.C. 154(b) by 0 days. days.

(21) Appl. No.: 15/692,147

(22) Filed: Aug. 31, 2017

(51) Int. Cl.
*A47L 9/14* (2006.01)

(52) U.S. Cl.
CPC ..... *A47L 9/1472* (2013.01); *A47L 9/1436* (2013.01); *A47L 9/1481* (2013.01)

(58) Field of Classification Search
CPC .... A47L 9/1472; A47L 9/1481; A47L 9/1436; A47L 9/14
See application file for complete search history.

(56) References Cited

U.S. PATENT DOCUMENTS 8,439,997 B2 5/2013 Rupp et al.

FOREIGN PATENT DOCUMENTS

WO WO-2009008799 1/2009

*Primary Examiner* — David Redding
(74) *Attorney, Agent, or Firm* — Schwegman Lundberg & Woessner, P.A.

(57) ABSTRACT

A vacuum cleaner is used with a detachable built-in filter bag, and includes a shell, a mounting piece, an intake tube, a cover plate, a bag holder, a blocking member, a prop member, a biasing spring, and a vacuum air stream generating member. The cover plate is configured to be brought into mating engagement with the shell so as to enclose a chamber in the shell. When no filter bag is installed inside a chamber of the shell, the cover plate is prevented from being brought into mating engagement with the shell. Once the cover plate is brought into mating engagement with the shell, the prop member is brought into pressing engagement with the blocking member to lift the blocking member.

5 Claims, 8 Drawing Sheets

VACUUM CLEANER

FIELD

The disclosure relates to a vacuum cleaner, more particularly to a vacuum cleaner used with a detachable built-in filter bag.

BACKGROUND

A conventional apparatus for attaching a filter bag to a vacuum sweeper is disclosed in U.S. Pat. No. 8,439,7997, and includes a sled and a sweeper housing. The sled includes an upper flange, a lower flange, and a spring. The upper and lower flanges are separated by a slot which is configured to receive a top plate of a filter bag having a key formed thereon. The spring extends into the slot. The sweeper housing is adjacent to the sled, and includes a cavity for receiving a portion of the filter bag, and a lock that interconnects with the key.

WO 2009/008799 discloses a vacuum cleaner which includes a dust collecting compartment, an intake sleeve projecting into the dust collecting compartment, a bag holder inside the dust collecting compartment, and an access lid for permitting access to the dust collecting compartment. The vacuum cleaner also includes a stop member on the bag holder adjacent the access lid and a positioning member inside the dust collecting compartment.

SUMMARY

An object of the disclosure is to provide a novel vacuum cleaner with simplified structure. When a filter bag in the vacuum cleaner is full, a cover plate can be detached from a shell for removal of the bag. If no filter bag is placed in the vacuum cleaner, the cover plate is prevented from being mounted to the shell.

According to the disclosure, a vacuum cleaner is used with a detachable built-in filter bag. The filter bag has a bag body and a reinforced plate. The bag body has a bag opening, and is configured to permit a vacuum air stream from the bag opening to pass therethrough, and to collect dust and dirt entrained in the vacuum air stream in the bag body. The reinforced plate has a plate opening, and is attached to the bag body such that the plate opening is in register with the bag opening, and such that a front marginal portion and a rear marginal portion of the reinforced plate are separable from the bag body. The vacuum cleaner includes a shell, amounting piece, an intake tube, a cover plate, a bag holder, a blocking member, a prop member, a biasing member, and a vacuum air stream generating member. The shell includes a right wall, a front wall, and a rear wall. The front and rear walls extend from two opposite edges of the right wall to respectively terminate at two left edges each extending in an upright direction. The mounting piece is configured to span between the front and rear walls so as to define, together with the right, front, and rear walls, a chamber for accommodation of the filter bag. The mounting piece is formed with a through bore, and has a marginal edge which is opposite to the right wall, and which extends in a transverse direction relative to the upright direction. The intake tube is fitted in the through bore and is secured to the mounting piece. The intake tube includes an air inlet disposed outwardly of the chamber, and an air outlet disposed in the chamber. The cover plate has a front marginal edge and a rear marginal edge that are configured to mate with the two left edges of the front and rear walls, respectively, so as to permit the cover plate to be removably brought into mating engagement with the shell to enclose the chamber. The cover plate has an inner surface formed with a groove configured to permit the marginal edge of the mounting piece to be received therein when the cover plate is in mating engagement with the shell. The bag holder is disposed in the chamber under the mounting piece, and includes a shaft, a first cantilever, and a second cantilever. The shaft is hinged to the right wall about a hinge axis, and extends along the hinge axis to terminate at two shaft end segments. Each of the first and second cantilevers extends from a corresponding one of the two shaft end segments to turn with the shaft about the hinge axis, and includes a cantilever body and an elongated guide that is disposed inboard of the cantilever body. The elongated guides of the first and second cantilevers are configured to permit the rear and front marginal portions to be guided thereon so as to allow the filter bag to be held by the bag holder. The blocking member is secured to a cantilever end of the cantilever body of the first cantilever, and is angularly displaceable with the first and second cantilevers about the hinge axis among (i) an uppermost position, where the bag holder is free from holding the filter bag, and the blocking member is disposed to prevent the marginal edge of the mounting piece from access to the groove, (ii) a lower position, where the filter bag is held by the bag holder, and the cover plate is detached from the shell, and (iii) a lifted position between the uppermost position and the lower position, where the filter bag is held by the bag holder, and the cover plate is in mating engagement with the shell. The prop member is disposed on the inner surface of the cover plate, and is configured such that once the cover plate is brought into mating engagement with the shell, the prop member is brought into pressing engagement with the blocking member to lift the blocking member to the lifted position thereby ensuring the air outlet to be inserted into the bag opening. The biasing spring is disposed to bias the blocking member to the uppermost position. The vacuum air stream generating member is disposed downstream of the filter bag to induce the vacuum air stream to flow from the air inlet through the filter bag.

BRIEF DESCRIPTION OF THE DRAWINGS

Other features and advantages of the disclosure will become apparent in the following detailed description of the embodiment with reference to the accompanying drawings, in which.

DETAILED DESCRIPTION

Figure 1:
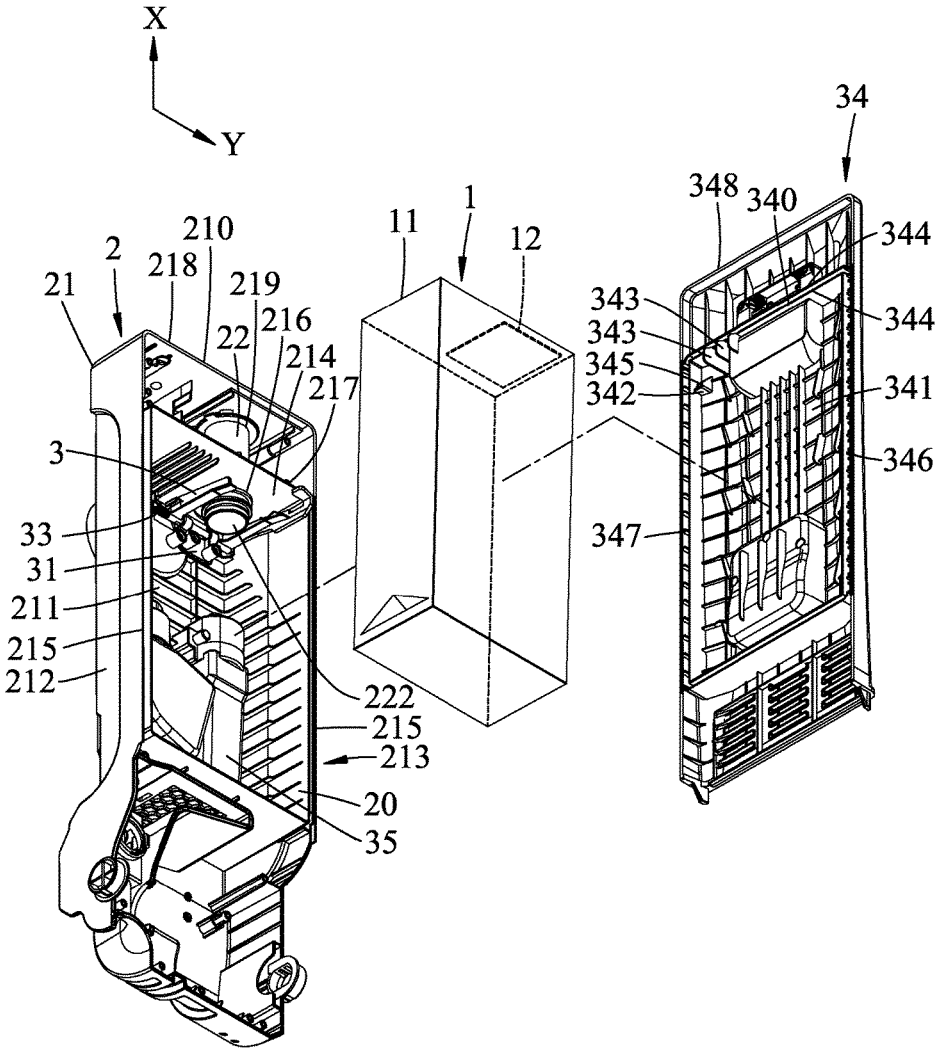
FIG. 1 is a fragmentary exploded perspective view of a vacuum cleaner according to an embodiment of the disclosure.
Figure 2:
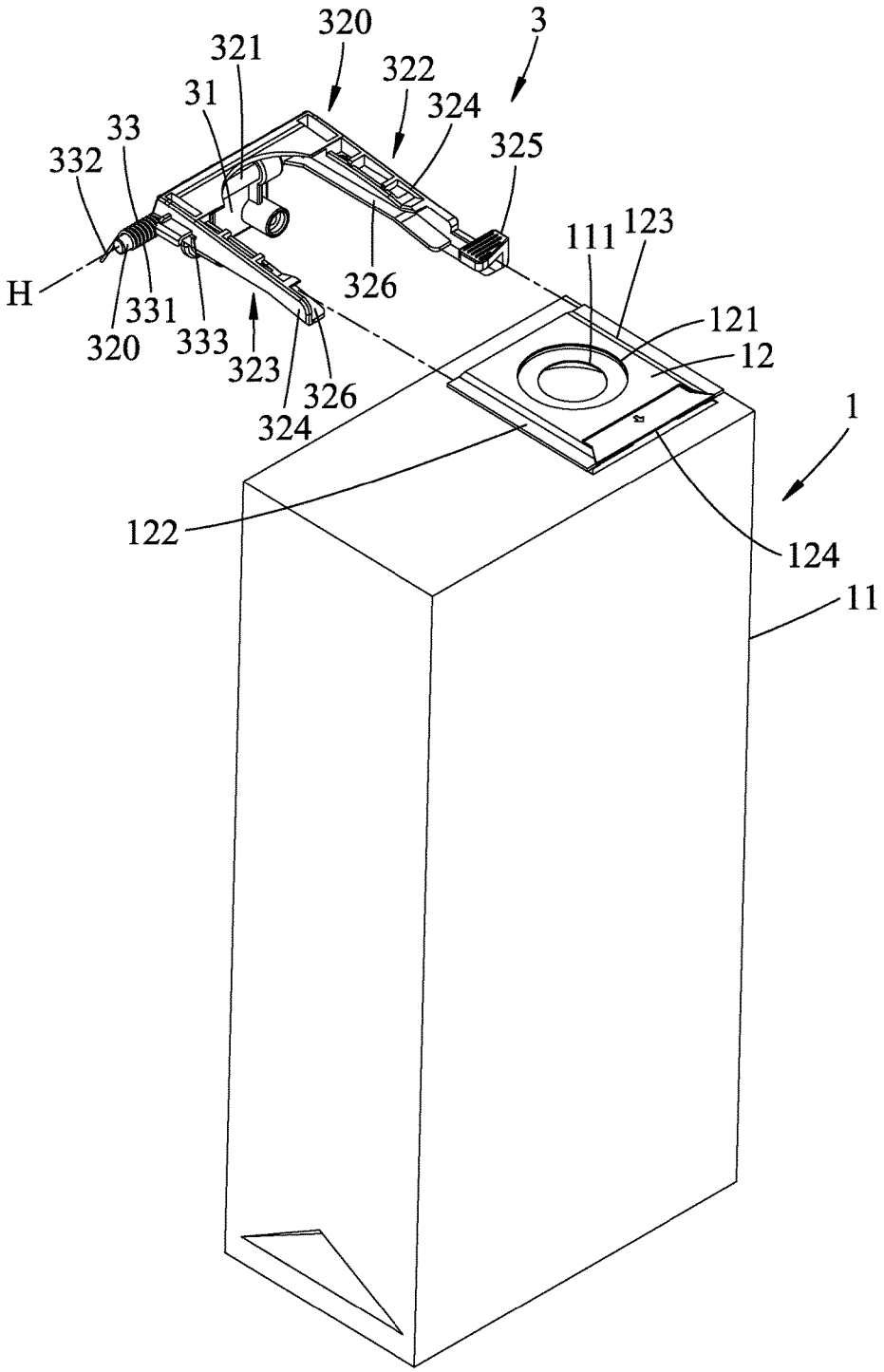
FIG. 2 is a perspective view illustrating a bag holder and a filter bag for the vacuum cleaner.

With reference to FIGS. 1 and 2, a vacuum cleaner 2 according to an embodiment of the disclosure is used with a detachable built-in filter bag 1, and is shown to include a shell 21, a mounting piece 214, an intake tube 22, a cover plate 34, a bag holder 3, a blocking member 325, a prop member 342, a biasing member 33, and a vacuum air stream generating member 35.

As shown in FIG. 2, the filter bag 1 has a bag body 11 and a reinforced plate 12. The bag body 11 has a bag opening 111, and is configured to permit a vacuum air stream from the bag opening 111 to pass therethrough, and to collect dust and dirt entrained in the vacuum air stream in the bag body 11. The reinforced plate 12 has a plate opening 121, and is attached to the bag body 11 such that the plate opening 121 is in register with the bag opening 111, and such that a front marginal portion 122 and a rear marginal portion 123 of the reinforced plate 12 are separable from the bag body 11.

Referring back to FIG. 1, the shell 21 is shown to include a right wall 211, a front wall 212, and a rear wall 213. The front and rear walls 213 extend from two opposite edges of the right wall 211 to respectively terminate at two left edges 215 each extending in an upright direction (X).

The mounting piece 214 is configured to span between the front and rear walls 212, 213. The mounting pieces 214, the right wall 211, the front wall 212, and the rear wall 213 cooperatively define therebetween a chamber 20 for accommodation of the filter bag 1. The mounting piece 214 is formed with a through bore 216, and has a marginal edge 217 which is opposite to the right wall 211, and which extends in a transverse direction (Y) relative to the upright direction (X).

In this embodiment, the shell 21 further includes a top wall 218 which extends leftwardly from an upper edge of the right wall 211 to terminate at a left edge 210 to be disposed above the mounting piece 214. The top wall 218 further extends in the transverse direction (Y) to interconnect upper edges of the front and rear walls 212, 213. The top wall 218 is formed with a through hole 219.

The intake tube 22 is fitted in the through bore 216 and is secured to the mounting piece 214. The intake tube 22 includes an air inlet 221 disposed outwardly of the chamber 20, and an air outlet 222 disposed in the chamber 20.

Figure 4:
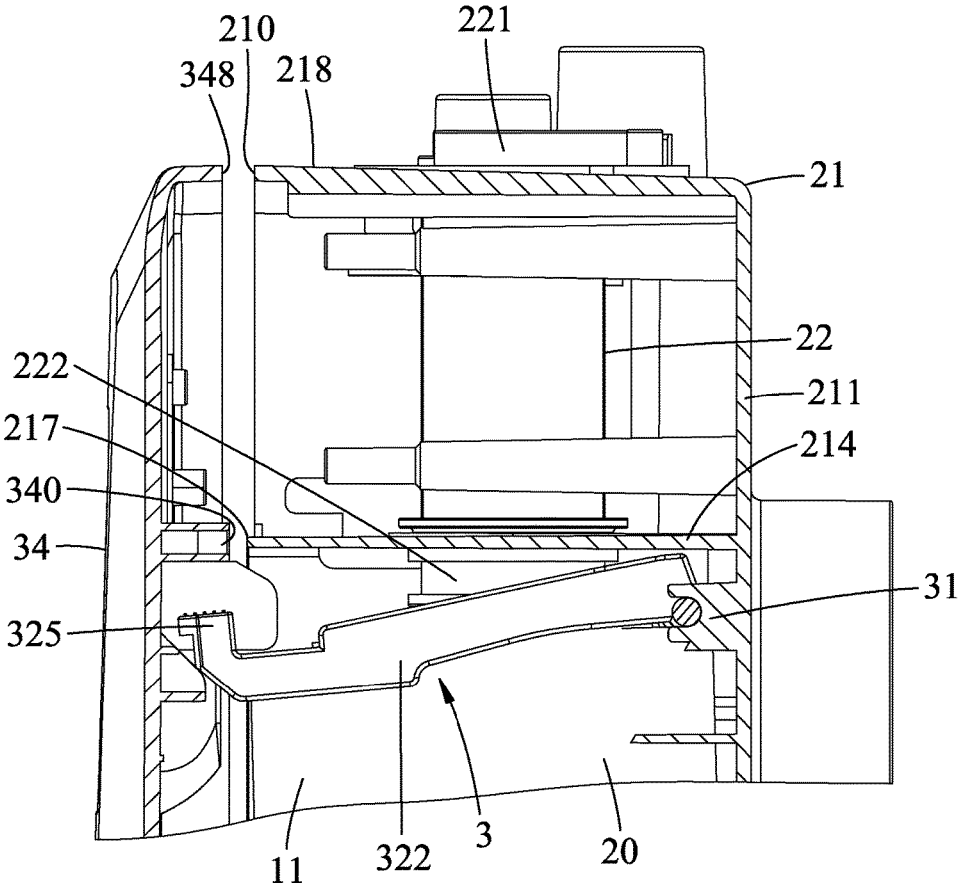
FIG. 4 is a cross-sectional view taken along line IV-IV of FIG. 3.

In this embodiment, the intake tube 22 is further fitted in the through hole 219 of the top wall 218, and is secured to the top wall 218 such that the air inlet 221 is disposed upwardly of the top wall 218 (see FIGS. 1 and 4).

Figure 6:
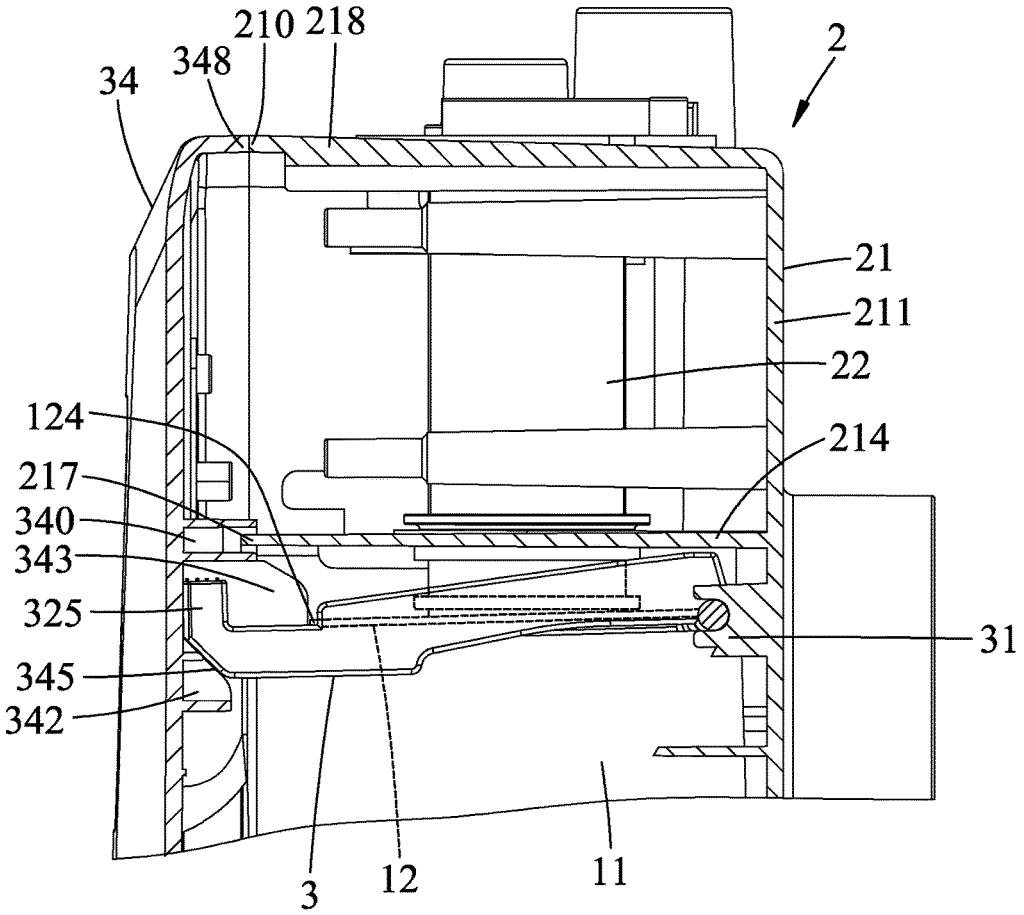
FIG. 6 is a cross-sectional view taken along line VI-VI of FIG. 5.

As shown in FIG. 1, the cover plate 34 has a front marginal edge 346 and a rear marginal edge 347, which are configured to mate with the two left edges 215 of the front and rear walls 212, 213, respectively, so as to permit the cover plate 34 to be removably brought into mating engagement with the shell 21 to enclose the chamber 20 (see FIG. 6). The cover plate 34 has an inner surface 341 formed with a groove 340 configured to permit the marginal edge 217 of the mounting piece 214 to be received therein when the cover plate 34 is in mating engagement with the shell 21.

In this embodiment, the cover plate 34 further has a top marginal edge 348 which are configured to mate with the left edge 210 of the top wall 218 when the cover plate 34 is in mating engagement with the shell 21.

As shown in FIGS. 1 and 2, the bag holder 3 is disposed in the chamber 20 under the mounting piece 214, and includes a mount 31, a shaft 321, a first cantilever 322, and a second cantilever 323.

The mount 31 is mounted to the right wall 211. The shaft 321 is hinged to the right wall 211 through the mount 31 about a hinge axis (H), and extends along the hinge axis (H) to terminate at two shaft end segments 320.

Each of the first and second cantilevers 322, 323 extends from a corresponding one of the two shaft end segments 320 to turn with the shaft 321 about the hinge axis (H). In addition, each of the first and second cantilevers 322, 323 includes a cantilever body 324 and an elongated guide 326 that is disposed inboard of the cantilever body 324. The elongated guides 326 of the first and second cantilevers 322, 323 are configured to permit the rear and front marginal portions 123, 122 of the reinforced plate 12 to be guided thereon so as to allow the filter bag 1 to be held by the bag holder 3.

The blocking member 325 is secured to a cantilever end of the cantilever body 324 of the first cantilever 322, and is angularly displaceable with the first and second cantilevers 322, 323 about the hinge axis (H) among an uppermost position, a lower position, and a lifted position between the uppermost position and the lower position.

Figure 7:
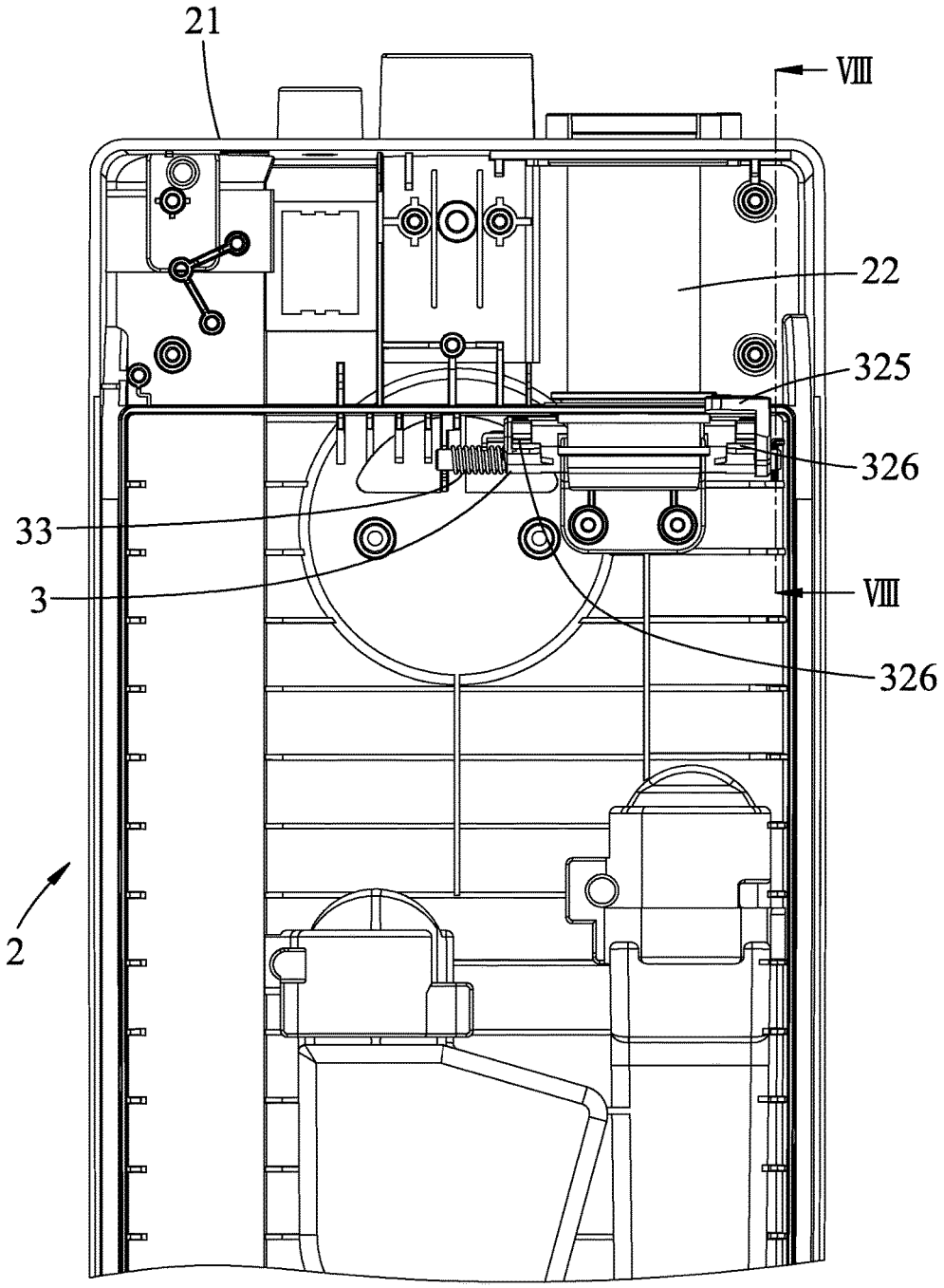
FIG. 7 is similar to FIG. 3 but illustrating a blocking member in an uppermost position.
Figure 8:
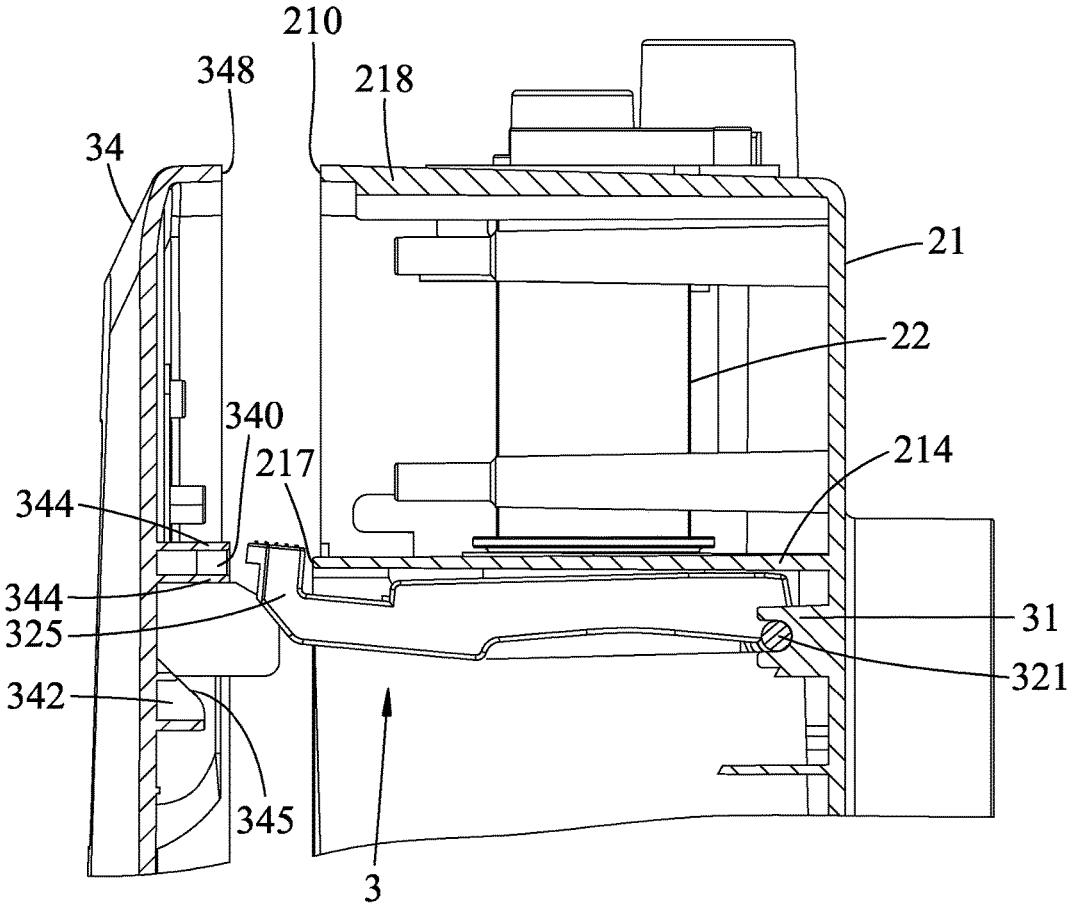
FIG. 8 is a cross-sectional view taken along line VIII-VIII of FIG. 7.

In the uppermost position, as shown in FIGS. 7 and 8, the bag holder 3 is free from holding the filter bag 1, and the blocking member 325 is disposed to prevent the marginal edge 217 of the mounting piece 214 from access to the groove 340.

Figure 3:
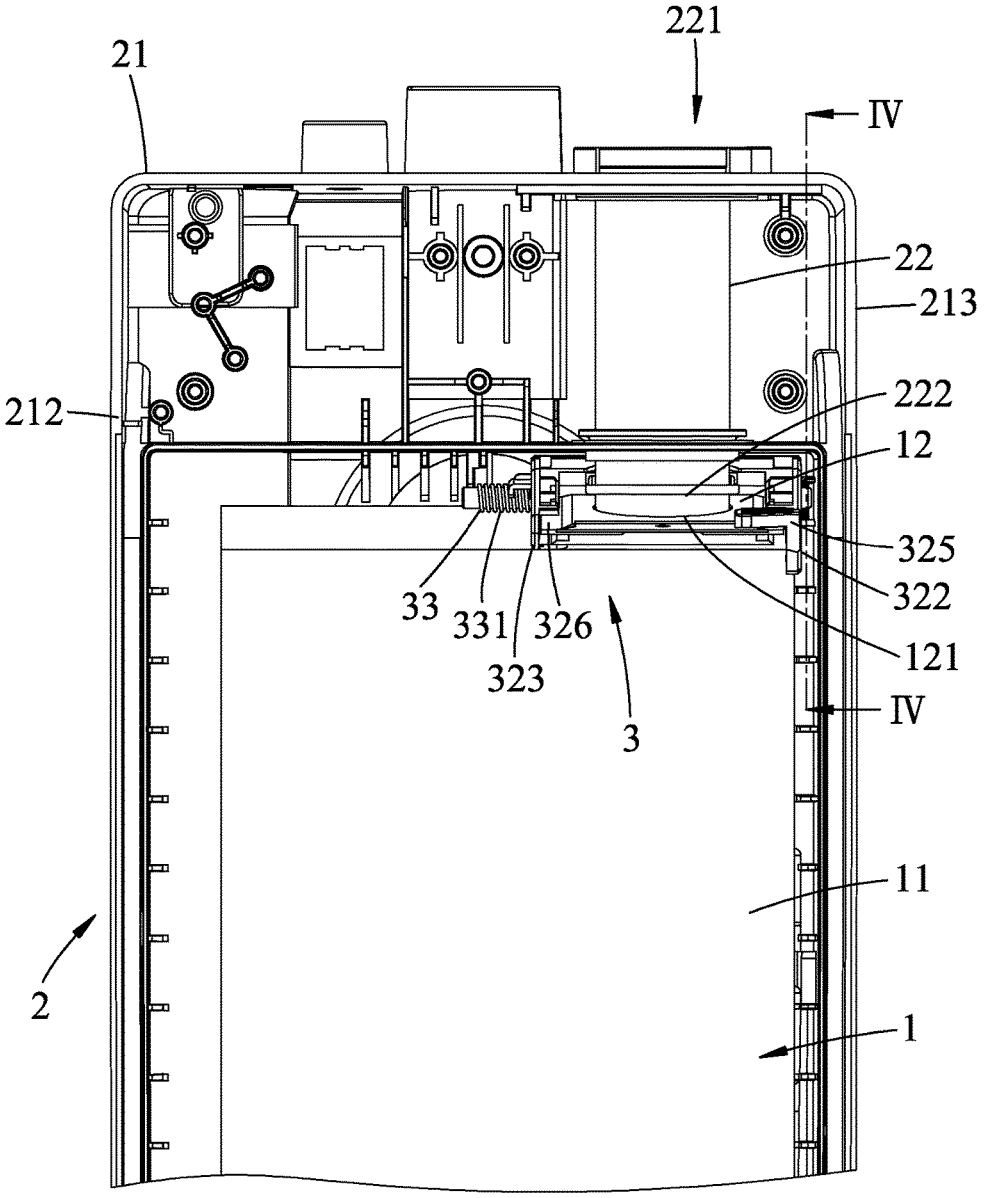
FIG. 3 is a fragmentary schematic view of the vacuum cleaner illustrating a blocking member in a lower position.

In the lower position, as shown in FIGS. 3 and 4, the filter bag 1 is held by the bag holder 3, and the cover plate 34 is detached from the shell 21.

Figure 5:
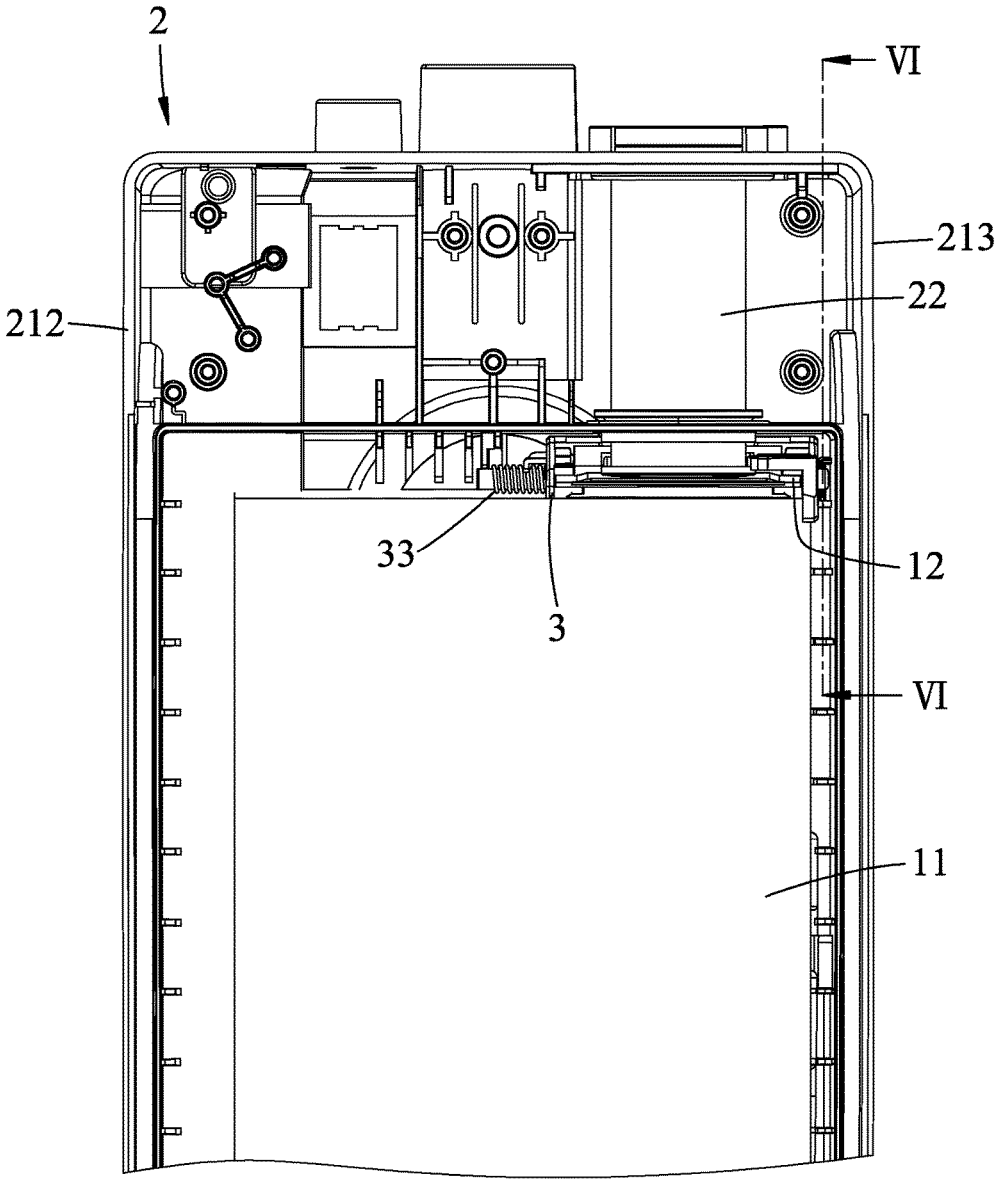
FIG. 5 is similar to FIG. 3 but illustrating a blocking member in a lifted position.

In the lifted position, as shown in FIGS. 5 and 6, the filter bag 1 is held by the bag holder 3, and the cover plate 34 is in mating engagement with the shell 21.

The prop member 342 is disposed on the inner surface 341 of the cover plate 34, and is configured such that once the cover plate 34 is brought into mating engagement with the shell 21 (see FIG. 6), a pressing surface 345 of the prop member 342 is brought into pressing engagement with the blocking member 325 to lift the blocking member 325 to the lifted position thereby ensuring the air outlet 222 to be inserted into the bag opening 111.

The biasing spring 33 is disposed to bias the blocking member 325 to the uppermost position.

In this embodiment, as shown in FIG. 2, the biasing spring 33 is a torsion spring, and includes a coiled segment 331, a first end segment 332, and a second end segment 333. The coiled segment 331 is sleeved on one of the two shaft end segments 320, and is disposed outboard of a corresponding one of the first and second cantilevers 322, 323. The first end segment 332 is disposed to abut against the rear wall 211. The second end segment 333 is disposed to abut against the corresponding one of the first and second cantilevers 322, 323 so as to exert a biasing force to the bag holder to thereby bias the blocking member 325 to the uppermost position. As shown in FIG. 2, the second end segment 333 is disposed to abut against the second cantilever 323.

The vacuum air stream generating member 35 is disposed downstream of the filter bag 1 to induce the vacuum air stream to flow from the air inlet 221 through the filter bag 1.

As shown in FIG. 1, the vacuum air stream generating member 35 is disposed in the chamber 20. Alternatively, the vacuum air stream generating member 35 may be disposed downstream of the chamber 20 based on requirement.

In this embodiment, the vacuum cleaner 2 further includes a plurality of fins 343 and two parallel ribs 344.

As shown in FIGS. 1 and 6, the fins 343 are disposed on the inner surface 341 of the cover plate 34, and are configured to be brought into abutting engagement with a left margin 124 of the reinforced plate 12 when the cover plate 34 is in mating engagement with the shell 21. In this case, when the filter bag 1 is installed in the vacuum cleaner and the cover plate 24 is in mating engagement with the shell 21, the reinforced plate 12 retained by the bag holder 3 can be further engaged by the fins 343. Therefore, even if the filter bag 1 with dust or dirt has an increased weight, the bag holder 3 is still able to hold the filter bag 1.

The parallel ribs 344 extend rightwardly from the inner surface 341 of the cover plate 34 so as to define the groove 340 between the ribs 344.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A vacuum cleaner used with a detachable built-in filter bag which has a bag body which has a bag opening, and which is configured to permit a vacuum air stream from the bag opening to pass therethrough, and to collect dust and dirt entrained in the vacuum air stream in the bag body, and a reinforced plate having a plate opening, and attached to the bag body such that the plate opening is in register with the bag opening, and such that a front marginal portion and a rear marginal portion of the reinforced plate are separable from the bag body, said vacuum cleaner comprising:

a shell including a right wall, and a front wall and a rear wall which extend from two opposite edges of said right wall to respectively terminate at two left edges each extending in an upright direction;

a mounting piece configured to span between said front and rear walls so as to define, together with said right, front, and rear walls, a chamber for accommodation of the filter bag, said mounting piece being formed with a through bore, and having a marginal edge which is opposite to said right wall, and which extends in a transverse direction relative to the upright direction;

an intake tube fitted in said through bore and secured to said mounting piece, said intake tube including an air inlet disposed outwardly of said chamber, and an air outlet disposed in said chamber;

a cover plate which has a front marginal edge and a rear marginal edge that are configured to mate with said two left edges of said front and rear walls, respectively, so as to permit said cover plate to be removably brought into mating engagement with said shell to enclose said chamber, and which has an inner surface formed with a groove configured to permit said marginal edge of said mounting piece to be received therein when said cover plate is in mating engagement with said shell;

a bag holder disposed in said chamber under said mounting piece, and including a shaft which is hinged to said right wall about a hinge axis, and which extends along the hinge axis to terminate at two shaft end segments, and a first cantilever and a second cantilever, each of which extends from a corresponding one of said two shaft end segments to turn with said shaft about the hinge axis, and each of which includes a cantilever body and an elongated guide that is disposed inboard of said cantilever body, said elongated guides of said first and second cantilevers being configured to permit the rear and front marginal portions to be guided thereon so as to allow the filter bag to be held by said bag holder;

a blocking member which is secured to a cantilever end of said cantilever body of said first cantilever, and which is angularly displaceable with said first and second cantilevers about the hinge axis among (i) an uppermost position, where said bag holder is free from holding the filter bag, and said blocking member is disposed to prevent said marginal edge of said mounting piece from access to said groove, (ii) a lower position, where the filter bag is held by said bag holder, and said cover plate is detached from said shell, and (iii) a lifted position between the uppermost position and the lower position, where the filter bag is held by said bag holder, and said cover plate is in mating engagement with said shell;

a prop member which is disposed on said inner surface of said cover plate, and which is configured such that once said cover plate is brought into mating engagement with said shell, said prop member is brought into pressing engagement with said blocking member to lift said blocking member to the lifted position thereby ensuring said air outlet to be inserted into the bag opening;

a biasing spring disposed to bias said blocking member to the uppermost position; and a vacuum air stream generating member which is disposed downstream of the filter bag to induce the vacuum air stream to flow from said air inlet through the filter bag.

2. The vacuum cleaner according to claim 1, wherein said biasing spring is a torsion spring, and includes a coiled segment which is sleeved on one of said two shaft end segments, and which is disposed outboard of a corresponding one of said first and second cantilevers, a first end segment disposed to abut against said rear wall, and a second end segment disposed to abut against said corresponding one of said first and second cantilevers so as to exert a biasing force to said bag holder to thereby bias said blocking member to the uppermost position.

3. The vacuum cleaner according to claim 1, further comprising a plurality of fins which are disposed on said inner surface of said cover plate, and which are configured to be brought into abutting engagement with a left margin of the reinforced plate when said cover plate is in mating engagement with said shell.

4. The vacuum cleaner according to claim 1, further comprising two parallel ribs which extend rightwardly from said inner surface of said cover plate so as to define said groove therebetween.

5. The vacuum cleaner according to claim 1, wherein:

said shell further includes a top wall which extends leftwardly from an upper edge of said right wall to terminate at a left edge to be disposed above said mounting piece, and which extends in the transverse direction to interconnect upper edges of said front and rear walls, said top wall being formed with a through hole configured to permit said intake tube to be fitted therein such that said air inlet is disposed upwardly of said top wall; and said cover plate further has a top marginal edge which are configured to mate with said left edge of said top wall when said cover plate is in mating engagement with said shell.

* * * * *